United States Patent [19]

Hunter

[11] 4,009,763

[45] Mar. 1, 1977

[54] POLE LADDER

[76] Inventor: Alex E. Hunter, 924 Chartiers Ave., Pittsburgh, Pa. 15220

[22] Filed: Dec. 3, 1975

[21] Appl. No.: 637,374

[52] U.S. Cl. ..... 182/187

[51] Int. Cl.[2] ..... A47C 9/10

[58] Field of Search ..... 182/187, 121, 120, 152, 182/156, 82

[56] References Cited

UNITED STATES PATENTS

| | | | |
|---|---|---|---|
| 505,343 | 9/1893 | Austin | 182/156 |
| 1,955,127 | 4/1934 | Heintz | 182/187 |
| 2,060,953 | 11/1936 | Strom | 182/187 |
| 2,855,980 | 10/1958 | Konieczka | 182/187 |
| 2,982,337 | 5/1961 | Arena | 182/187 |
| 3,817,350 | 6/1974 | Gray | 182/187 |

*Primary Examiner*—Reinaldo P. Machado
*Attorney, Agent, or Firm*—William J. Ruano

[57] ABSTRACT

A collapsible ladder for suspension on a pole, securely in place, by the mere stepping on the platform or treads which effects insertion of cleats into the pole. A chain, which surrounds the pole for supporting the ladder, is tightly gripped around the pole by turning a swivelly mounted tightening screw.

2 Claims, 3 Drawing Figures

POLE LADDER

This invention relates to a collapsible ladder that is to be mounted on a pole to allow climbing to short distances for fastening thereon plates bearing identifying indicia and for similar purposes.

An outstanding disadvantage of commonly used ladders that might be useful for the abovementioned purpose is that they are generally heavy and cumbersome in construction and not readily mountable on a pole nor collapsible.

Another outstanding disadvantage of the abovementioned ladders used in the past is that they have no truly safe securing means for mounting the ladder on the pole so as to safely hold the weight of the person climbing the ladder, particularly a very heavy person.

An object of my invention is to provide a novel ladder which is collapsible to a very small and easily portable unit and which is devoid of the abovementioned disadvantages of well known types of ladders.

A further object of my invention is to provide a novel chain tightening device for suspending the ladder of the present invention on a pole in a very secure manner.

Other objects and advantages will become more apparent from a study of the following description, taken with the accompanying drawing wherein.

Figure 2:
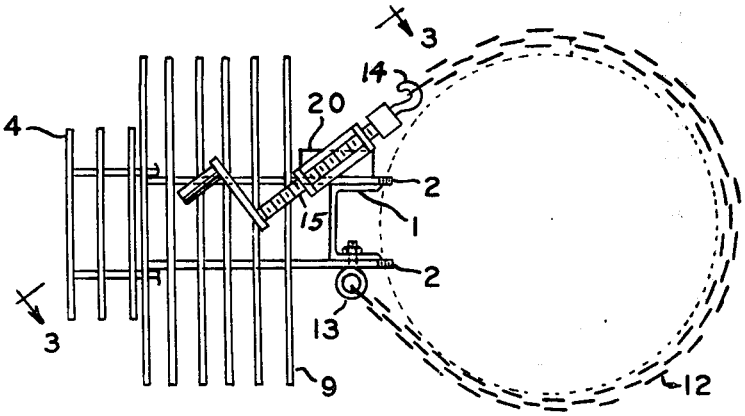
FIG. 2 is a top view of the assembly shown in FIG. 1.
Figure 3:
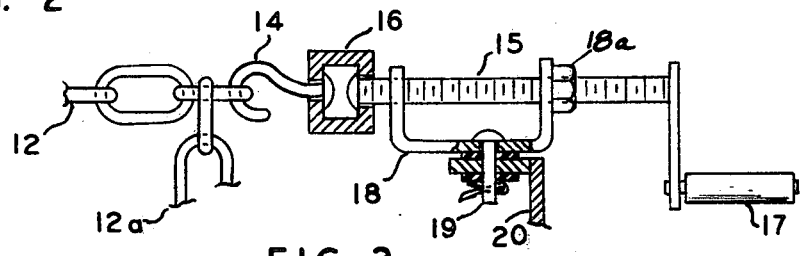
FIG. 3, is an enlarged, fragmentary elevational view of the chain tightening mechanism shown in FIG. 2.
Figure 1:
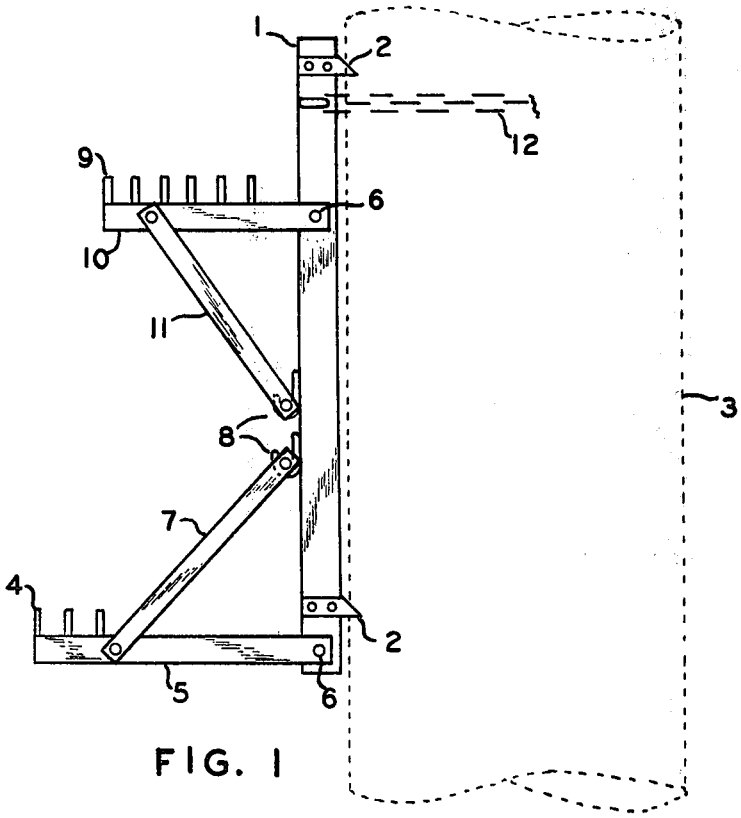
FIG. 1 is a side, elevational view showing a portable collapsible ladder embodying the principles of the present invention and illustrating the ladder in the operable position mounted on a pole shown in dotted outline.

Referring more particularly to FIGS. 1 and 2 of the drawing, numeral 1 denotes a channel, preferably of aluminum having a length of about 2 ft. and having side flanges onto the outer sides of which are rigidly mounted claws or cleats 2, preferably at each end of the flanges, making a total of four, which dig into the pole 3 particularly as the result of the weight of the person climbing the ladder to be described hereinafter.

The ladder is collapsible and comprises a lower step or platform 4 in the form of grating welded to the top of a pair of brackets 5 pivotally mounted, by bolts 6, to the side flanges of the channel 1. A pair of braces 7, one pivotally secured to the side of each bracket 5, are connected together at their extremities by a rod or tubing which is detachably seatable in a laterally elongated hook or trough 8.

Similarly a second step or platform 9, made up of grating welded to the top of a pair of brackets 10 pivoted by bolts 6 to channel 1, is supported by a pair of braces 11, one on each side of the two brackets 10 and the lower ends of which are interconnected by a rod or tubing which seats into a second elongated hook 8.

Obviously, when it is desired to collapse the ladder, the braces 11 are lifted so that the rod bridging their lower ends is unseated from hook 8. Similarly braces 7 are lifted so that the interconnecting seated rod bridging their upper ends are unseated from the lower hook 8, after which the entire assembly pivots about the upper and lower bolts 6 to collapse the ladder into a compact package.

In order to mount the ladder on a pole or tree 3, shown in dotted outline, a link chain 12 of ordinary construction is provided, having one end connected to an eye 13 secured to a flange of channel 1 and the other end portion hooked onto a hook 14 with the excess of the chain 12a dangling.

The chain is tightly wrapped around the pole by means of a tightening screw 15 which is turned about its axis with a bolt head contained within a cylindrical enclosure 16 made up of a piece of tubing with welded ends, while the hook 14 has a similar head inside of said enclosure whereby the hook does not turn as the result of turning movements of the screw 15 effected by turning of a handle 17, particularly when brass washers (not shown) are next to the bolt heads. Such turning is done within a bolt 18a welded to a bracket 18 screw threadedly connected at both ends to the screw 15 and mounted by a rivet 19 having a cotter pin so as to mount the bracket 18 swivelly on the rigid support 20 which is integrally secured to the channel 1. All the structural parts are preferably made of aluminum for lightness, except heavily stressed parts which are made of steel.

In operation, as best seen in FIG. 2, when the handle 17 is turned, the angularity of the screw 15 and bracket 18 will be adjusted, by the swivel mounting, to any diameter of pole automatically until the free end of the chain connected to hook 14 is tightened to such extent that the top cleats 2 pierce the pole. The bottom ones pierce by the weight of the climber on the platforms.

When it is desired to detach the chain from the pole, handle 17 is turned in an opposite direction so as to loosen the chain, which is finally detached from hook 14. The platforms or steps 4 and 9 are then collapsed by unseating brackets 7 and 11 from the hooks 8 so as to provide a compact and very small sized package for the entire ladder assembly.

The ladder may also be secured to a pole at any height for a worker to stand on (or sit) while performing work to reduce fatigue.

While only two steps have been shown, it will be obvious to those skilled in the art that additional steps may be similarly added to the channel 1, if so desired.

Thus it will be seen that I have provided a highly efficient and extremely compact, collapsible ladder for suspension on a pole by means of a chain and tightener assembly automatically adjusted to the particular circumference of the pole for securely fastening the ladder, by means of cleats, to the pole.

While I have illustrated and described a single specific embodiment of my invention, it will be understood that this is by way of illustration only and that various changes and modifications may be contemplated in my invention and within the scope of the following claims.

I claim:

1. A ladder assembly for suspension from a pole or similar structure, comprising a channel having side flanges, a pair of cleats, each connected to one of said side flanges for piercing said pole, a ladder pivotally mounted in a collapsible manner on said side flanges, said ladder comprising a pair of collapsible steps of different width, the lower one being greater, each comprising a platform supported by a pair of braces interconnected by a rod at their extremities, a pair of hooks secured to spaced points along said channel for receiving said rods when the ladder is in operating position, and a chain tightening means swivelly mounted on one of said flanges and automatically adjustable in direction to the circumference of the pole for tightly embracing the pole and piercing it with said cleats.

2. An assembly as recited in claim 1 together with a second pair of cleats secured to the bottom of said side flanges which pierce said pole as the result of the weight of the person stepping on said steps, said first mentioned pair of cleats being secured to the top of said side flanges.

* * * * *